US010309403B2

(12) United States Patent
Hwang et al.

(10) Patent No.: US 10,309,403 B2
(45) Date of Patent: Jun. 4, 2019

(54) ECCENTRIC BUSH ASSEMBLY STRUCTURE OF SCROLL COMPRESSOR

(71) Applicant: Hanon Systems, Daejeon (KR)

(72) Inventors: In Guk Hwang, Gyeonggi-do (KR); Kweon Soo Lim, Daejeon (KR); Soo Cheol Jeong, Dajeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 15/506,020

(22) PCT Filed: Jan. 26, 2016

(86) PCT No.: PCT/KR2016/000806

§ 371 (c)(1),
(2) Date: Feb. 23, 2017

(87) PCT Pub. No.: WO2016/140437

PCT Pub. Date: Sep. 9, 2016

(65) Prior Publication Data

US 2017/0356445 A1 Dec. 14, 2017

(30) Foreign Application Priority Data

Mar. 4, 2015 (KR) ..... 10-2015-0030134
Dec. 23, 2015 (KR) ..... 10-2015-0184487

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 18/00*** | (2006.01) |
| ***F04C 29/00*** | (2006.01) |
| ***F04C 18/02*** | (2006.01) |

(52) U.S. Cl.

CPC ..... *F04C 29/0057* (2013.01); *F04C 18/0215* (2013.01); *F04C 2230/25* (2013.01); *F04C 2240/40* (2013.01); *F04C 2240/60* (2013.01); *F04C 2240/807* (2013.01); *F04C 2280/02* (2013.01)

(58) Field of Classification Search

CPC ..... F04C 18/0215; F04C 23/008; F04C 29/0057; F04C 2230/25; F04C 2240/60; F04C 2240/40; F04C 2240/807; F04C 2280/02

USPC ..... 418/55.1–55.6, 57

See application file for complete search history.

(56) References Cited

U.S. PATENT DOCUMENTS

| | | | | |
|---|---|---|---|---|
| 5,366,360 A * | 11/1994 | Bookbinder | ..... | F04C 18/0215 418/55.5 |
| 2005/0002800 A1* | 1/2005 | Kimura | ..... | F04C 18/0215 418/55.1 |
| 2014/0255231 A1* | 9/2014 | Kii | ..... | F04C 18/0215 418/55.1 |

FOREIGN PATENT DOCUMENTS

| | | |
|---|---|---|
| CN | 101761474 A | 6/2010 |
| JP | H09105390 A | 4/1997 |

(Continued)

*Primary Examiner* — Theresa Trieu

(74) *Attorney, Agent, or Firm* — Shumaker, Loop & Kendrick, LLP; James D. Miller

(57) ABSTRACT

An eccentric bush assembly structure of a scroll compressor, in which an orbiting scroll is eccentrically coupled to a rotary shaft of a drive motor, including a bush body rotatably coupled to the orbiting scroll while being pinned to the rotary shaft of the drive motor by an eccentric shaft, the bush body having a friction prevention groove formed in a surface facing a tip surface of the rotary shaft so as not to come into frictional contact with the tip surface.

8 Claims, 3 Drawing Sheets

(56) References Cited

FOREIGN PATENT DOCUMENTS

| | | | |
|---|---|---|---|
| JP | 2002161879 | A | 6/2002 |
| JP | 2010174796 | A | 8/2010 |
| JP | 2012067602 | A | 4/2012 |
| JP | 2012167605 | A | 9/2012 |
| JP | 2012211549 | A | 11/2012 |
| KR | 20050060336 | A | 6/2005 |
| KR | 1020050060346 | A | 6/2005 |
| KR | 20110093267 | A | 8/2011 |
| KR | 20140030566 | A | 3/2014 |
| KR | 1020140095702 | A | 8/2014 |
| KR | 1020140109826 | A | 9/2014 |

* cited by examiner

ECCENTRIC BUSH ASSEMBLY STRUCTURE OF SCROLL COMPRESSOR

CROSS-REFERENCE TO RELATED PATENT APPLICATIONS

This patent application is a United States national phase patent application based on PCT/KR2016/000806 filed Jan. 26, 2016, which claims the benefit of Korean Patent Application No. 10-2015-0030134 filed Mar. 4, 2015 and Korean Patent Application No. 10-2015-0184487 filed Dec. 23, 2015, the disclosures of which are hereby incorporated herein by reference in their entirety.

TECHNICAL FIELD

The present invention relates to an eccentric bush assembly structure of a scroll compressor, and more particularly, to an eccentric bush assembly structure of a scroll compressor, which is capable of allowing an orbiting scroll to turn by eccentrically coupling the orbiting scroll to a rotary shaft of a drive motor in an electric scroll compressor.

BACKGROUND ART

Vehicles are generally equipped with air-conditioning systems for cooling/heating the interior thereof. Such an air-conditioning system includes a compressor, as one of the components of a cooling system, which compresses a low-temperature and low-pressure gas refrigerant introduced from an evaporator to convert it into a high-temperature and high-pressure gas refrigerant, and which transfers the converted gas refrigerant to a condenser.

As an example of a compressor serving to compress a refrigerant in a vehicle cooling system, there are a reciprocating compressor which compresses a refrigerant during reciprocation and a rotary compressor which compresses a refrigerant during rotation. The reciprocating compressor includes a crank compressor which transfers a driving force from a drive source to a plurality of pistons using a crank, a swash plate compressor which transfers a driving force from a drive source to a rotary shaft equipped with a swash plate, and a wobble plate compressor which utilizes a wobble plate. The rotary compressor includes a vane rotary compressor which utilizes a rotary shaft and a vane, and a scroll compressor which utilizes an orbiting scroll and a fixed scroll.

Referring to FIGS. 1 to 3, a scroll compressor 100 includes a housing 200, a fixed scroll 300 provided inside the housing 200, a drive motor 400 which drives an orbiting scroll 600, an eccentric bush 500 which is coupled to a rotary shaft 410 of the drive motor 400, and the orbiting scroll 600 which is coupled to the eccentric bush 500 to revolve around the fixed scroll 300 and defines a compression chamber.

The orbiting scroll 600 is eccentrically coupled to an eccentric shaft 411 of the rotary shaft 410 by the eccentric bush 500. The eccentric bush 500 serves to turn the orbiting scroll 600 using rotary power transferred from the rotary shaft 410. The eccentric bush 500 is integrally formed with a balance weight 550 for balancing it according to the eccentric rotation thereof.

As illustrated in FIG. 3, when the rotary shaft 410 rotates together with the eccentric bush 500, a tip surface 412 of the rotary shaft 410 comes into frictional contact with a bushing surface 510 of the eccentric bush 500. In this case, since the bushing surface 510, i.e. the sliding surface, has a poor surface roughness, sludge is generated due to friction when a compressor is driven, resulting in contamination in a compression space.

That is, the whole shape of the eccentric bush 500 is formed by forging, and a portion of the eccentric bush 500, which requires accurate dimensions, is additionally processed by a lathe. In a cutting process by the lathe, the center portion of the lathe, as a center of rotation, has a low cutting speed, and therefore the surface of the eccentric bush 500 is rough. Accordingly, when the processing of the eccentric bush 500 is completed in the state in which it has a rough sliding surface, the surface of the sliding surface is cut during friction with the rotary shaft 410 of the drive motor 400.

SUMMARY OF THE DISCLOSURE

The present invention has been made in view of the above problems relating to the conventional eccentric bush assembly structure of a scroll compressor, and an object thereof is to provide an eccentric bush assembly structure of a scroll compressor, which is capable of preventing generation of sludge due to frictional contact between a bushing surface, which has a poor surface roughness in turning, and a tip portion of a rotary shaft of a drive motor.

In accordance with an aspect of the present invention, an eccentric bush assembly structure of a scroll compressor includes a bush body rotatably coupled to an orbiting scroll while being pinned to a rotary shaft of a drive motor by an eccentric shaft, the bush body having a busing surface facing a tip surface of the rotary shaft, wherein a friction prevention groove is formed in at least one of the bushing surface of the bush body and the tip surface of the rotary shaft, and forms a non-contact portion between the bush body and the rotary shaft.

The friction prevention groove may have a circular shape.

A center of the circular friction prevention groove may be formed on a centerline of rotation of the rotary shaft.

The bush body may be formed with a pin hole into which the eccentric shaft is fitted, and the friction prevention groove may be formed in the bushing surface of the bush body, and may partially overlap the pin hole of the bush body.

The rotary shaft may be formed with a pin hole into which the eccentric shaft is fitted, and the friction prevention groove may be formed in the tip surface of the rotary shaft, and may not overlap the pin hole of the rotary shaft.

The bush body may have a rotary shaft receiving groove rotatably receiving a tip portion of the rotary shaft of the drive motor, and the bushing surface may be formed in the rotary shaft receiving groove.

The friction prevention groove may have an area of 20 to 70% of that of the bushing surface of the rotary shaft receiving groove.

The friction prevention groove may have a depth of 1 mm or less.

The friction prevention groove may have a diameter of 9 to 12 mm when a lathe has a rotational speed of 3000 to 4000 rpm and a tool has a cutting speed of 125 m/min in turning.

The friction prevention groove may be formed together with the bush body by forging.

The bush body may be integrally formed with a balance weight.

As is apparent from the above description, in accordance with an eccentric bush assembly structure of a scroll compressor according to the present invention, it is possible to prevent frictional contact between a bushing surface, which has a poor surface roughness in turning, and a tip portion of a rotary shaft of a drive motor, thereby preventing contamination of a compressor due to generation of sludge during the frictional contact.

BEST MODE FOR INVENTION

Reference will now be made in detail to embodiments of the present invention, examples of which are illustrated in the accompanying drawings.

Figure 1:
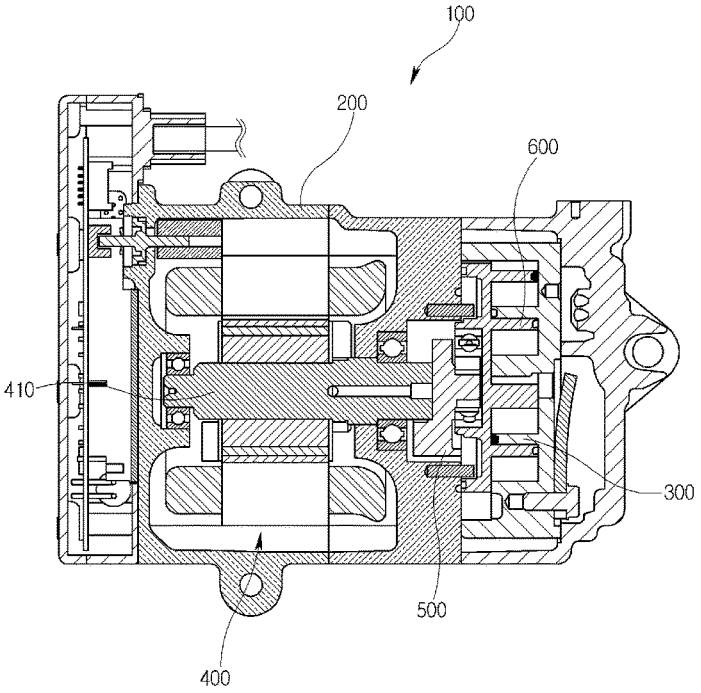
FIG. 1 PRIOR ART
FIG. 1 is a side cross-sectional view schematically illustrating a typical scroll compressor.
Figure 2:
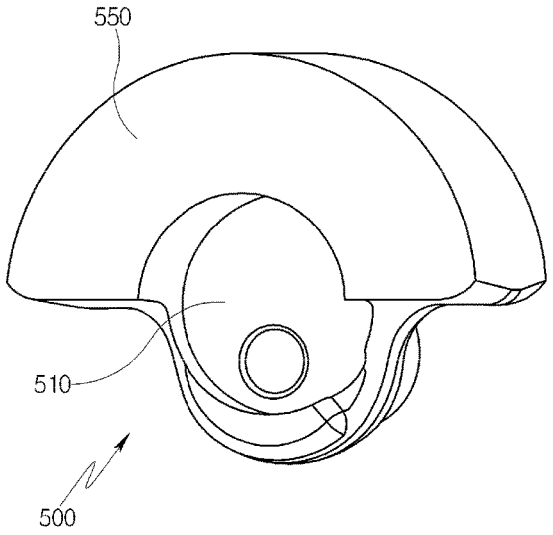
FIG. 2 PRIOR ART
FIG. 2 is a perspective view illustrating a conventional eccentric bush assembly structure of a scroll compressor.
Figure 3:
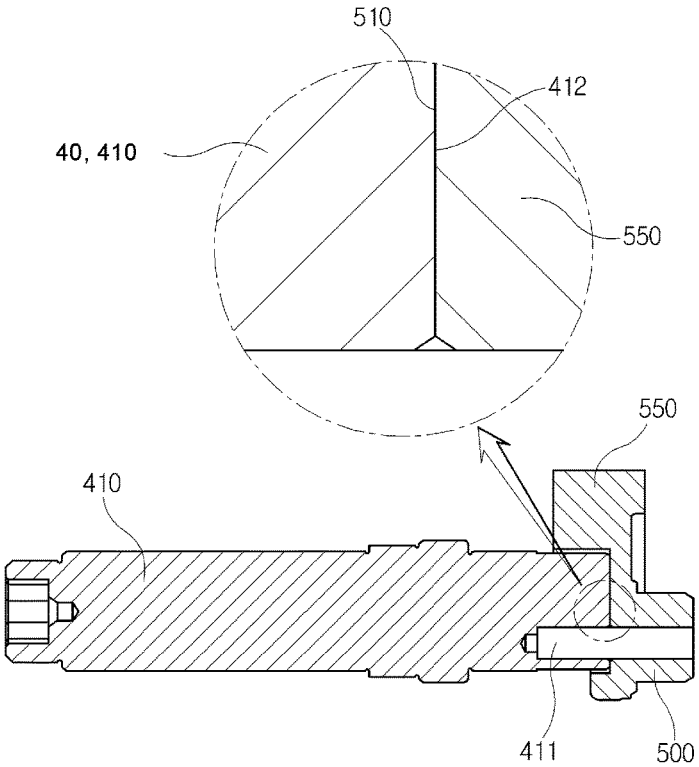
FIG. 3 PRIOR ART
FIG. 3 is a side cross-sectional view illustrating the coupling state of the eccentric bush illustrated in FIG. 2.
Figure 4:
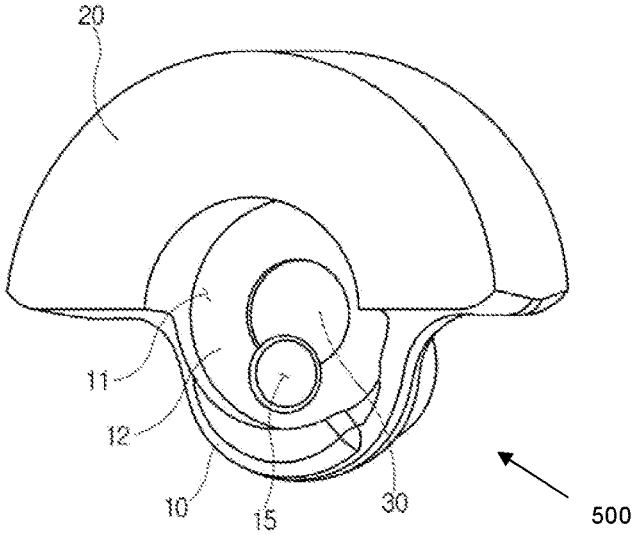
FIG. 4 is a perspective view illustrating an eccentric bush assembly structure of a scroll compressor according to an embodiment of the present invention.
Figure 5:
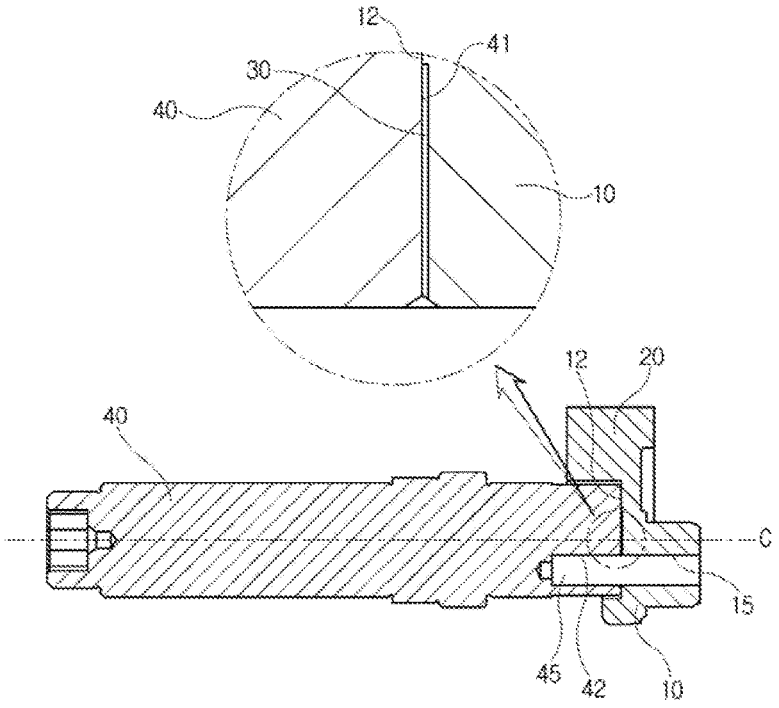
FIG. 5 is a side cross-sectional view illustrating a coupling state in the eccentric bush assembly structure of a scroll compressor illustrated in FIG. 4.

Referring to FIGS. 1, 4, and 5, an eccentric bush 500 of a scroll compressor according to an embodiment of the present invention includes a bush body 10 which eccentrically couples an orbiting scroll 600 to a rotary shaft 40 of a drive motor 400.

One side of the bush body 10 is rotatably coupled to the orbiting scroll 600, while the other side thereof is pinned to the rotary shaft 40 of the drive motor 400 by an eccentric shaft 45.

The bush body 10 has a rotary shaft receiving groove 11, which is formed in one side thereof and rotatably receives the tip portion of the rotary shaft 40 of the drive motor 400. The rotary shaft receiving groove 11 is formed with a bushing surface 12 which comes into frictional contact with a tip surface 41 of the rotary shaft 40. The bushing surface 12 is a surface which faces the tip surface 41 of the rotary shaft 40 while coming into frictional contact therewith, in the state in which the rotary shaft 40 is fitted into the rotary shaft receiving groove 11.

A pin hole 15, into which the eccentric shaft 45 of the rotary shaft 40 is fitted, is formed in one side of the busing surface 12 of the rotary shaft receiving groove 11. The pin hole 15 is formed at an eccentric position that is spaced apart from a centerline of rotation C of the rotary shaft 40 by a predetermined distance. Thus, the eccentric bush 500 may turn about the pin hole 15 by a predetermined width relative to the rotary shaft 40. Since the turning operation of the eccentric bush 500 in the scroll compressor 100 is known, a detailed description thereof will be omitted.

The bushing surface 12 of the rotary shaft receiving groove 11 has a friction prevention groove 30 formed at a position adjacent to the pin hole 15.

The friction prevention groove 30 is formed on the centerline of rotation C of the rotary shaft 40. That is, the friction prevention groove 30 has a circular shape, and the center thereof is located on the centerline of rotation C of the rotary shaft 40. Accordingly, when the eccentric bush 500 turns about the rotary shaft 40, a portion of the tip surface 41 of the rotary shaft 40 does not come into frictional contact with the bushing surface 12. The bushing surface 12 formed with the friction prevention groove 30 is a portion having a poor surface roughness since it is located at the center of rotation C of the eccentric bush 500 in turning. Therefore, the friction prevention groove 30 is formed in the above portion in a recessed manner, thereby preventing the generation of sludge due to the frictional contact between the tip surface 41 of the rotary shaft 40 and the bushing surface 12 of the bush body 10.

That is, the friction prevention groove 30 prevents the tip surface 41 of the rotary shaft 40 from coming into frictional contact with the bushing surface 12 of the bush body 10. Consequently, it is possible to prevent the generation of sludge due to frictional contact between the tip surface 41 of the rotary shaft 40 and the bushing surface 12 of the bush body 10 even though the rotary shaft 40 rotates together with the eccentric bush 500.

The friction prevention groove 30 is formed in the central portion of the bushing surface 12. The edge of the bushing surface 12, which is not formed with the friction prevention groove 30, has a good surface roughness even after the turning. Therefore, sludge is hardly generated in the edge of the bushing surface 12 even though the edge of the bushing surface 12 comes into frictional contact with the tip surface 41 of the rotary shaft 40.

The friction prevention groove 30 may have a circular shape by turning. In this case, the diameter of the friction prevention groove 30 may vary depending on the processing condition when the friction prevention groove 30 is turned. For example, when a lathe has a rotational speed of 3000 to 4000 rpm and a tool has a feed speed, i.e. a cutting speed of 125 m/min in turning, the friction prevention groove 30 preferably has a diameter of about 10 mm. In this case, the surface roughness in the turning is relatively poor in the range of about 10 mm.

Meanwhile, the friction prevention groove 30 may be formed by forging. That is, when the bush body 10 is processed by forging, the friction prevention groove 30 is also processed by forging without separate turning.

Here, the friction prevention groove 30 preferably has an area of 20 to 70% of that of the bushing surface 12 of the rotary shaft receiving groove 11. That is, when the area of the friction prevention groove 30 is $S_1$ and the area of the bushing surface 12 of the rotary shaft receiving groove 11 is $S_0$, the following condition is preferably satisfied:

$$0.2 \leq \frac{S_1}{S_0} \leq 0.7.$$

When the area $S_1$ of the friction prevention groove 30 is less than 20% of the area $S_0$ of the bushing surface 12, there is a high possibility that sludge is generated. When the area $S_1$ of the friction prevention groove 30 is more than 70% of the area $S_0$ of the bushing surface 12, there is a high possibility that noise occurs due to the excitation of the contact surface.

In addition, the friction prevention groove 30 preferably has a depth of 1 mm or less. When the depth of the friction prevention groove 30 is higher than 1 mm, there is a high possibility that noise occurs due to the excitation of the contact surface.

As illustrated in FIG. 4, when the friction prevention groove 30 is formed in the busing surface 12 of the rotary shaft receiving groove 11, together with the pin hole 15, the friction prevention groove 30 may partially overlap the pin hole 15. That is, each of the friction prevention groove 30 and the pin hole 15 has a circular shape, and the sum of the diameter of the friction prevention groove 30 and the diameter of the pin hole 15 is larger than the straight length from the center of the friction prevention groove 30 to the center of the pin hole 15.

The friction prevention groove 30 must be formed on the centerline of rotation C of the rotary shaft 40 to have a circular shape and must be larger than a portion in which a poor surface roughness is formed in turning, and the diameter and position of the pin hole 15 must be specifically designed. Therefore, the friction prevention groove 30 is formed so as to partially overlap the pin hole 15.

Figure 6:
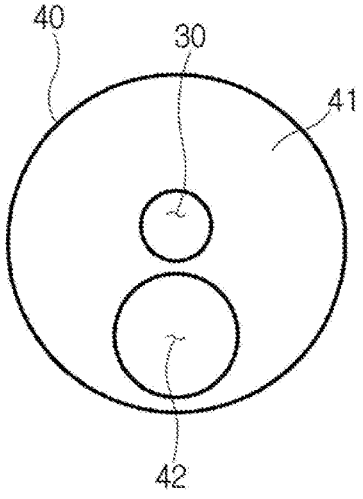
FIG. 6 is a side cross-sectional view illustrating an eccentric bush assembly structure of a scroll compressor according to another embodiment of the present invention.

Meanwhile, as illustrated in FIG. 6, a friction prevention groove 30 may be formed in the tip surface 41 of the rotary shaft 40. The pin hole 42, into which the eccentric shaft 45 is fitted, is formed in the tip surface 41 of the rotary shaft 40. The eccentric shaft 45 is fitted into both of the pin hole 15 formed in the bush body 10 and the pin hole 42 formed in the rotary shaft 40.

The friction prevention groove 30 has a circular shape, and does not overlap the pin hole 42 of the rotary shaft 40. That is, the circle forming the outer diameter of the friction prevention groove 30 partially overlaps the pin hole 15 formed in the bushing surface 12, as illustrated in FIG. 4. On the other hand, the circle forming the outer diameter of the friction prevention groove 30 does not overlap the pin hole 42 formed in the rotary shaft 40, as in another embodiment illustrated in FIG. 6. If the friction prevention groove 30 is formed so as to overlap the pin hole 42, the outer wall of the pin hole 42 is cut and worn, which may lead to deterioration of the pin support force of the eccentric shaft 45.

As illustrated in FIG. 6, since the friction prevention groove 30 and the pin hole 42 are spaced apart from each other so as not to overlap each other, the outer wall of the pin hole 42 has a uniform height as a whole. Consequently, the pin support force is uniformly distributed throughout the outer wall of the pin hole 42, thereby preventing the pin support force from deteriorating.

In this case, the friction prevention groove 30 must have an area equal to or more than 20% of that of the bushing surface 12. Here, since the rotary shaft 40 is processed so as to be fitted into the rotary shaft receiving groove 11 of the bush body 10 within an allowable tolerance, as illustrated in FIG. 5, the area of the bushing surface 12 of the bush body 10 may be considered to be equal to the area of the tip surface 41 of the rotary shaft 40.

The bush body 10 may be integrally formed with a balance weight 20. The balance weight 20 serves to balance the eccentric bush 500 according to the eccentric rotation thereof, and protrudes from one side of the bush body 10 while having a circular shape.

Although embodiments have been described with reference to a number of illustrative embodiments thereof, it should be understood that numerous other modifications and applications may be devised by those skilled in the art that will fall within the intrinsic aspects of the embodiments.

In addition, it is to be understood that differences relevant to the variations and modifications fall within the spirit and scope of the present disclosure defined in the appended claims.

The invention claimed is:

1. An eccentric bush assembly structure of a scroll compressor, in which an orbiting scroll is eccentrically coupled to a rotary shaft of a drive motor, comprising:

a bush body rotatably coupled to the orbiting scroll while pinned to the rotary shaft of the drive motor by an eccentric shaft, the bush body having a bushing surface facing a tip surface of the rotary shaft, wherein a friction prevention groove is formed in at least one of the bushing surface of the bush body and the tip surface of the rotary shaft and forms a non-contact portion between the bush body and the rotary shaft, wherein the friction prevention groove has a circular shape, wherein a center of the circular shape of the friction prevention groove is formed on a centerline of rotation of the rotary shaft, and wherein the rotary shaft is formed with a pin hole into which the eccentric shaft is fitted and the friction prevention groove is formed in the tip surface of the rotary shaft and does not overlap the pin hole of the rotary shaft.

2. The eccentric bush assembly structure according to claim 1, wherein:

the bush body is formed with a pin hole into which the eccentric shaft is fitted; and the friction prevention groove is formed in the bushing surface of the bush body and partially overlaps the pin hole of the bush body.

3. An eccentric bush assembly structure of a scroll compressor, in which an orbiting scroll is eccentrically coupled to a rotary shaft of a drive motor, comprising:

a bush body rotatably coupled to the orbiting scroll while pinned to the rotary shaft of the drive motor by an eccentric shaft, the bush body having a bushing surface facing a tip surface of the rotary shaft, wherein a friction prevention groove is formed in at least one of the bushing surface of the bush body and the tip surface of the rotary shaft and forms a non-contact portion between the bush body and the rotary shaft, wherein the bush body has a rotary shaft receiving groove rotatably receiving a tip portion of the rotary shaft of the drive motor and the bushing surface is formed in the rotary shaft receiving groove.

4. The eccentric bush assembly structure according to claim 3, wherein a relationship between an area of the friction prevention groove $S_1$ and an area of the bushing surface $S_0$ of the rotary shaft receiving groove satisfies the following condition:

$$0.2 \leq \frac{S_1}{S_0} \leq 0.7.$$

5. The eccentric bush assembly structure according to claim 4, wherein the friction prevention groove has a depth of 1 millimeter or less.

6. The eccentric bush assembly structure according to claim 3, wherein the friction prevention groove is formed together with the bush body by forging.

7. The eccentric bush assembly structure according to claim 3, wherein the bush body is integrally formed with a balance weight.

8. An eccentric bush assembly structure of a scroll compressor, in which an orbiting scroll is eccentrically coupled to a rotary shaft of a drive motor, comprising:

a bush body rotatably coupled to the orbiting scroll while pinned to the rotary shaft of the drive motor by an eccentric shaft, the bush body having a bushing surface facing a tip surface of the rotary shaft, wherein a friction prevention groove is formed in at least one of the bushing surface of the bush body and the tip surface of the rotary shaft and forms a non-contact portion between the bush body and the rotary shaft, wherein the friction prevention groove has a circular shape, wherein the friction prevention groove has a diameter in a range of 9 to 12 millimeters when a lathe has a rotational speed of 3000 to 4000 revolutions per minute and a tool has a cutting speed of 125 meters per minute in turning.

* * * * *